US005566993A

United States Patent [19]

Olivas

[11] Patent Number: 5,566,993

[45] Date of Patent: Oct. 22, 1996

[54] DOOR LOCKING DEVICE

[76] Inventor: George Olivas, P.O. Box 7411, Las Vegas, Nev. 89125

[21] Appl. No.: 248,604

[22] Filed: May 25, 1994

[51] Int. Cl.[6] ..... F05C 19/18

[52] U.S. Cl. ..... 292/288; 292/292; 292/293

[58] Field of Search ..... 292/288, 289, 292/291, 292, 295–298, 290, 293, 256.71, 256.73, 258

[56] References Cited

U.S. PATENT DOCUMENTS

| | | | |
|---|---|---|---|
| 633,078 | 9/1899 | Crane . | |
| 793,098 | 6/1905 | Rohrer | 292/292 |
| 1,055,830 | 3/1913 | Tafe . | |
| 1,412,340 | 4/1922 | Cruikshank . | |
| 1,429,536 | 9/1922 | Robinson . | |
| 1,671,454 | 5/1928 | Stoutenburgh . | |
| 1,833,710 | 11/1931 | Gearhart | 292/291 |
| 1,888,425 | 11/1932 | Dowling . | |
| 2,160,460 | 5/1939 | McNaney . | |
| 2,161,673 | 6/1939 | Hammond | 292/290 |
| 2,288,022 | 6/1942 | O'Brien et al. . | |
| 2,442,733 | 6/1948 | Schultz . | |
| 2,588,077 | 3/1952 | Beadle | 292/295 |
| 2,673,112 | 3/1954 | Andrews | 292/296 |
| 3,494,653 | 2/1970 | Steele . | |
| 3,589,761 | 6/1971 | Lambert . | |
| 4,200,317 | 4/1980 | Polselli et al. | 292/293 |
| 4,285,535 | 8/1981 | Leary | 292/293 |
| 4,763,938 | 8/1988 | Schlanger | 292/290 |
| 5,193,867 | 3/1993 | Husted . | |
| 5,221,116 | 6/1993 | Lan . | |
| 5,325,685 | 7/1994 | Frank | 292/292 X |

*Primary Examiner*—Peter M. Cuomo
*Assistant Examiner*—Monica E. Millner
*Attorney, Agent, or Firm*—Quirk & Tratos

[57] ABSTRACT

A device is provided for the locking of one or more doors. In particular, the device comprises a strap, a door engaging member, and a frame. The strap has a first end which includes an outwardly extending projection for engagement with a door latch recess. The strap has a second end which is curved away from the first, and includes a stop mounted thereon. The frame is slidably located on the strap, allowing it to be moved towards and away from a door. Further, a door engaging member in the form of an adjustable bolt is provided on the frame. The frame includes slots in the walls thereof which are engageable with notches and tabs on the strap, preventing movement of the frame along the strap when the door engaging member is used to engage and lock a door.

18 Claims, 2 Drawing Sheets

90
42
48
50a
52a
46
32
54a
38
42
30
50b
28
56
52b
54b
40
22
34
24
68
80
70
76
72
62
66
20
72
59
60
26
78
74

DOOR LOCKING DEVICE

FIELD OF THE INVENTION

The present invention relates to a door lock. In particular, the present invention relates to a portable door locking device comprising a first door latch recess engaging member and a second door engaging member located thereon.

BACKGROUND OF THE INVENTION

It has been found desirable to provide portable door locking devices. Such devices are particularly useful by travelers who desire the extra security of a door lock which is completely internally operated. These devices are also particularly desirable for use with doors not having locks.

Prior portable or otherwise easily installable and removable door lock devices have suffered from numerous drawbacks. In particular, some of these devices are not completely self-contained in the sense that something must be done to the door or frame to enable one to use the lock. For example, padlocks and the like are easily engageable and removable from a door. On the other hand, to allow the padlock to be useful, tabs or metal loops or the like must be secured to the door and frame.

Numerous self-contained door locks have been devised to lock a door without any modification of the door. Unfortunately, these locks have not been extremely useful in their locking capacity, or have not been simple in their design and use.

For example, U.S. Pat. No. 3,494,653 to Steele discloses a door locking device which includes a strap for engaging a door, and a rotatable engaging pin located thereon. Unfortunately, while the device is easy to use, because the pin can rotate about a point on the strap, excessive pressure on the door can cause the pin to rotate away from the door, allowing it to be unlocked.

U.S. Pat. No. 1,429,536 to Robinson discloses a device which includes a strap which engages a recess, and a clip which is attachable to the strap on which is located a door engaging bolt. Unfortunately, this design suffers from several drawbacks. In particular, high enough pressures against the door could result in the clip releasing from the strap, thus unlocking the door.

Further, this clip with the bolt thereon must be removed from the strap each time the door to be locked (or unlocked) is opened or closed. This is not only inconvenient, but presents many opportunities for the clip to be lost. Lastly, in order for the clip to be easily detachable from the strap, it must be made quite springy, which allows it to be more easily dislodged during use. On the other hand, if the clip is rigid enough to remain in the strap, it is not easily removable by hand.

Further, U.S. Pat. No. 5,193,867 discloses a door locking device which comprises a clip attached to a strap. Unfortunately, this lock design suffers from several drawbacks. Primarily, the clip may only engage the door at discrete intervals, often preventing the door from being closed as tightly as desired. This is a serious drawback. For example, often the door lock is not simply used to prevent opening of a door a sufficient distance to allow a human therethrough, but is used to secure a door completely shut. Such may be the case where the door is exposed on the outside to the elements and is not properly weather-proofed. In such instances, it is desirable to press the door as tightly as possible against the frame to prevent insects, drafts, or water, from passing by the door.

There is thus a need for a door lock which is easily installed on a door and removed therefrom, which securely holds a door shut, and which is of a simple design.

SUMMARY OF THE INVENTION

In order to overcome the above stated problems and limitations, there is provided a portable door lock device. In general, the device comprises a strap having first and second ends, a frame slidably located on the strap, and a door engaging member located on the frame.

The strap is preferably a flat, elongate member having an outwardly extending projection or finger at the first end thereof. The projection is sized for engagement with the recess which is provided for a door latch located in a door or door frame. Stop means are provided at the second end of the strap, for preventing the frame from sliding off of the strap. Further, it is preferred that the strap be curved from the first to the second end.

Two sets of notches are preferably provided in the strap on top and bottom edges thereof. The first set of aligned notches is preferably located behind the outwardly extending recess engaging member. A second set of aligned notches is located rearwardly along the strap from the first set of notches. The distance between the notches is preferably chosen to allow the frame to engage both sets of notches simultaneously. Further, outwardly extending tabs or lugs are provided just behind the second set of notches on the strap.

The frame preferably comprises first and second walls connected by a base and top and bottom members. The first and second walls preferably each have an aligned longitudinal slot therein, the slot having a width just great enough to allow the frame to pass over the strap and the tabs thereon. Further, the walls are separated by a distance which allows the slots therein to simultaneously engage the first and second sets of notches in the strap.

A through hole is also located in each of the walls of the frame. The door engaging means preferably comprises a threaded bolt located in the holes of the frame. The bolt includes a first user engaging end and a second end comprising a foot for engaging a door.

In use, a door is opened, and the strap of the present device is located such that the outwardly extending projection at the first end thereof engages the door latch recess. With the frame slid along the strap towards the second end thereof, the door to be locked is then closed. The frame is then slid along the strap until it engages the notches in the strap. At this time, release of the frame allows the slots therein to engage the notches, while simultaneously causing the tabs located behind the second set of notches on the strap to engage the frame. In this manner, rearward movement of the frame on the strap is prevented.

The door engaging member is then advanced towards the door and into engagement therewith. At that time, the door is securely locked.

Unlocking of the door simply involves backing the door engaging member off, and then lifting the frame upwardly and sliding it along the strap towards the second end. At that time, the door may be opened.

Further objects, features, and advantages of the present invention will become apparent from the detailed description of the drawings which follows, when considered with the attached figures.

DETAILED DESCRIPTION OF THE PREFERRED EMBODIMENT

Figure 1:
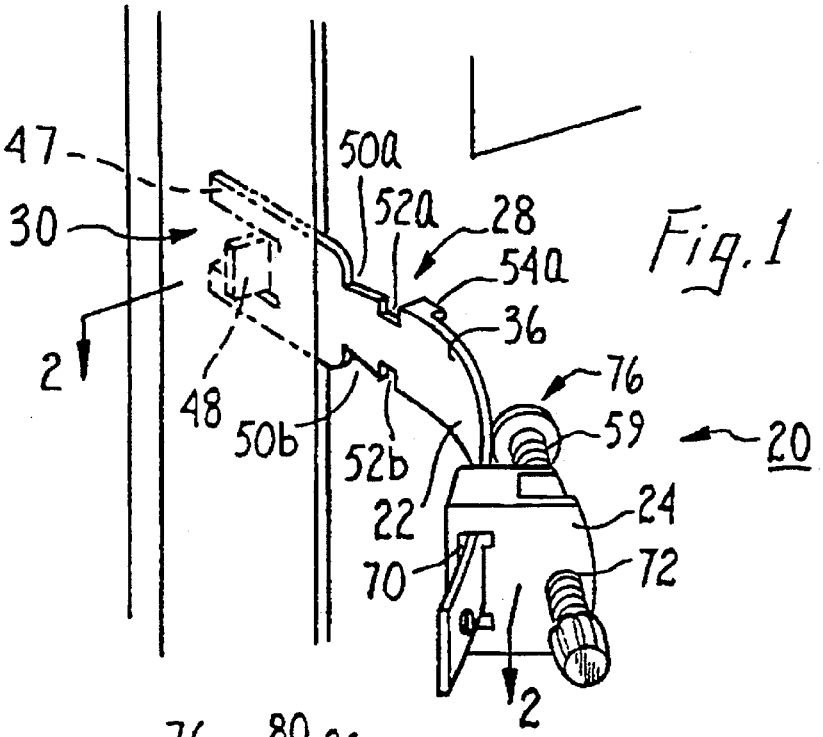
FIG. 1 is a perspective view of a door lock device of the present invention, with a strap thereof engaging a door frame and a frame members located on the strap.
Figure 3:
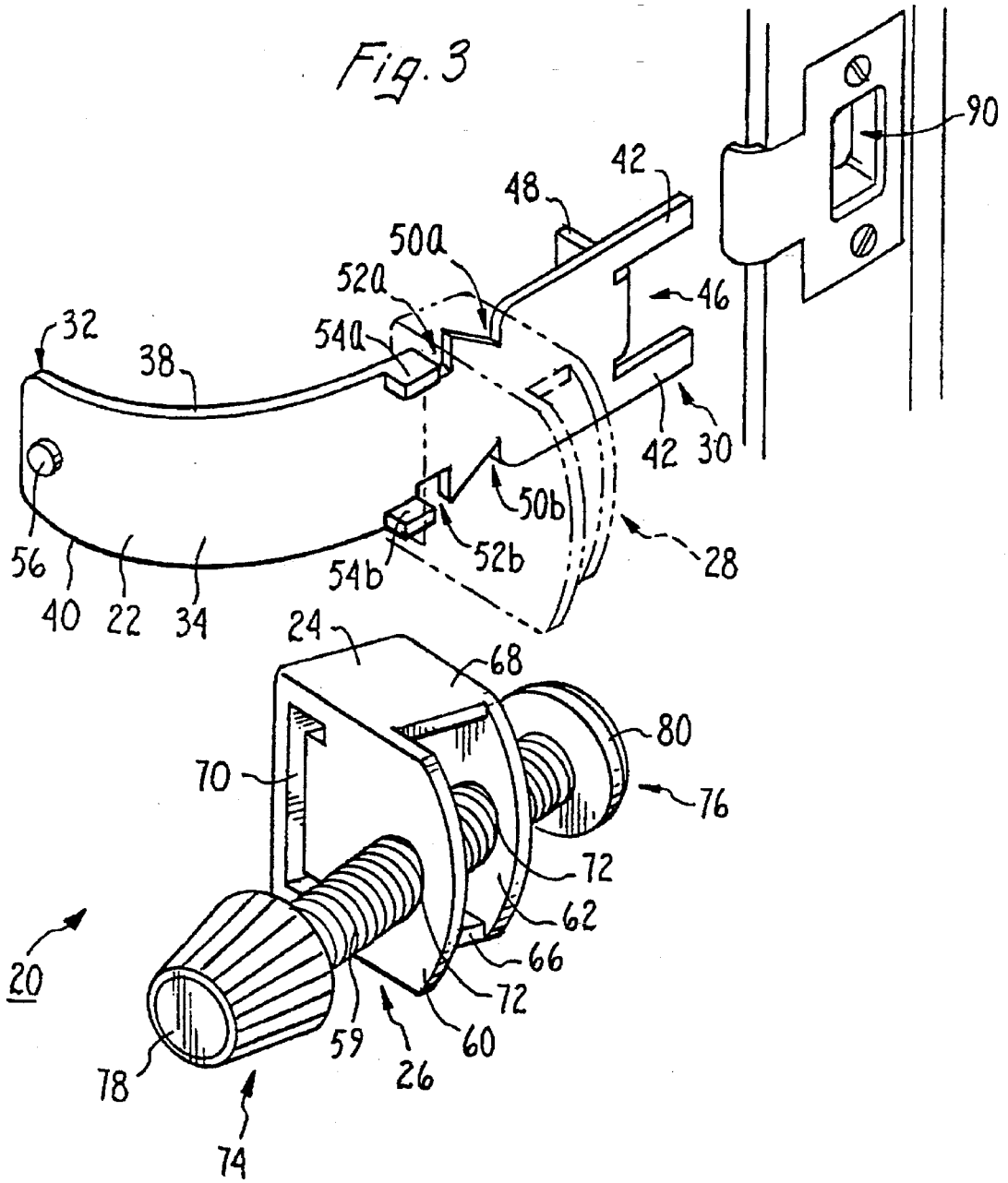
FIG. 3 is an exploded view of the door lock device of the present invention illustrating the strap, frame, and a representative door latch recess for engagement of the strap therewith.

FIGS. 1 and 3 illustrate the door locking device 20 of the present invention. As described in more detail below, the device 20 preferably comprises a strap 22, a frame 24 located thereon, a door engaging member 59 located on the frame 24, and means for securing 28 the frame 24 to the strap 22.

The strap 22 preferably comprises a thin, elongate member having a first end 30, second end 32, first side 34, second side 36, and first edge 38 and second edge 40. The strap 22 is preferably made of steel or some other strong, rigid material, and may be stamped or cut from a sheet of material (and later bent, as described below) to produce the strap 22. The strap 22 may have any number of dimensions. One size which has been found suitable is where the strap 22 has a height from first edge 38 to second edge 40 of about ⅞ inches and a length from first end 30 to second end 32 of about 3 and ½ to 3 and ¾ inches, and most preferably of 3 and ⅝ inches.

The first end 30 of the strap 22 preferably includes two outwardly extending fingers 42. These fingers 42 preferably extending outwardly from the main portion of the strap 22 by about ½ to ¾ of an inch, and most preferably about 11/16 of an inch. The fingers 42 are preferably separated from one another by about 1 inch, resulting in an opening 46 therebetween. Preferably, the spacing of the fingers 42 results in an opening 46 which is sized to allow passage therethrough of a bolt or latch. The fingers 42 are preferably produced with the strap 22.

An outwardly extending projection 48 is located adjacent the fingers 42 at the first end 30 of the strap 22. The projection 48 most preferably comprises a bent over section of material which is removed to form the opening 46 between the fingers 42.

The projection 48 preferably extends outwardly from the strap 22 nearly perpendicular to the second side 36 and first edge 38 of the strap 22. Most preferably the projection 48 extends perpendicularly to the second side 36 and first edge 38 of the strap 22. The projection 48 is preferably only about ½ inch high, in order that it may fit into any door latch or bolt engaging recess in a door frame or another door. Further, the projection 48 preferably only extends outwardly from the strap 22 by about ¾ inch, in order that when it is inserted into a door bolt or latch recess, the fingers 42 may be lie flush against the door or door frame surrounding the recess.

The second end 32 of the strip 22 is preferably curved away from the first end 30, thus causing the strap 22 to not be flat. In fact, at about the midpoint of the length of the strap 22, and on toward the second end 32 thereof, the strap 22 is preferably bent towards the second side 36 thereof. The result is that the second end 32 of the strap 22 curves outwardly in the same direction as the projection 48. The total amount of curvature may vary, but is chosen to allow a door to be opened and closed, with the frame 24 still on the strap 22, as will be described in more detail below. For a frame 24 sized as described below, the curvature preferably results in the very second end 32 of the strap 22 lying approximately 1 and ¼ to 1 and ½ inches, and most preferably 1 and 3/16 inches, over from a plane parallel to the first side 34 at the fingers 42.

Located just distal (towards the second end 32) of the fingers 42 at the first end 30 of the strap 22 is a first set of notches 50*a,b*. As illustrated, these notches 50*a,b* each preferably comprise a section of material removed from the strap 22 in the form of a tapered wedge. The notches 50 could, of course, take on any variety of shapes. The notches 50*a,b* are aligned with each other on at the first and second edges 38,40 of the strap 22. In the preferred form, each notch 50*a,b* preferably has a maximum depth of about ⅛ inch.

A second set of notches 52*a,b* are located distal of the first set 50*a,b*. The spacing between the sets of notches 50,52 is chosen to allow engagement therewith by the frame 24, as described in more detail below. The second set of notches 52*a,b* preferably comprise rectangular or square cutouts in the strap 22. Again, preferably the notches 52*a,b* are aligned with one another in the first and second edges 38,40 of the strap 22. Most preferably, each of these notches 52*a,b* has a depth of about ⅛ inch and a width of about ⅛ inch.

A set of outwardly extending tabs 54*a,b* are preferably located adjacent the second set of notches 52*a,b*. Each tab 54*a,b* preferably extends approximately perpendicular to the first side 34 and first edge 38 outwardly from the first side 34. The tabs 54*a,b* preferably have a width of about ⅛ inch, and extend outwardly about ⅛ inch. The exact distance the tabs 54*a,b* extend outwardly is chosen to allow the frame 24, when mounted thereon, to pass over them, as described in more detail below.

Lastly, a stop 56 is preferably located on the second end 32 of the strap 22. The stop 56 may comprise an outwardly extending member on either side 34,36 of the strap 22. In any case, the stop 56 preferably extends outwardly from the strap 22 by about 1/16 inch, or any distance which is sufficient to prevent removal of the frame 24 therefrom, once the frame 24 is located on the strap 22.

As described above, while the strap 22 comprises a thin strip of material, several modifications are preferably made thereto. Thus, while the strap 22 may be stamped or cut from a sheet of material, several subsequent bending and stamping operations may be necessary to created the features thereon described above. Such manufacturing steps are believed to be well known to one skilled in the art.

The frame 24 is a structure which is designed to be located on the strap 22 and hold a door engaging member 59. In the preferred form, the frame 24 comprises a first and second walls 60,62 which are connected by a base 64 and top and bottom members 66,68. Thus, in the preferred form, the frame 24 comprises, in essence, an box with an open end.

Each of the components of the frame 24 preferably comprise thin pieces of steel or other strong, rigid material, which are joined together. Preferably, each wall 60,62 is shaped as illustrated, having a three straight sides, and a fourth rounded or arched side. (need dimensions for size of walls).

The base 64, and top and bottom members 66,68 are attached to the walls 60,62 in order to provide support to the frame 24. The walls 60,62 could, of course, be connected to one another by many other means or structures.

Each wall 60,62 preferably includes a slot 70 therein. This slot 70 has is preferably located in the walls 60,62 near the base 64. The slot 70 has a length which is approximately the same as the height of the strap 22. The width of the slot 70 is chosen to allow the frame 24 to be slid along the strap 22 and over the tabs 54 thereon. Thus, the top and bottom portion of the slot 70 has approximately the same width as the distance the tabs 54 extend from the strap 22, and the remainder of the slot has a width about the same as the strap 22.

A hole 72 is also provided in each wall 60,62. The hole 72 is sized to allow passage therethrough of a door engaging member 59. In the embodiment illustrated, the hole 72 has a diameter of about ¼ to ⅜ of an inch, and most preferably about 9/32 inch. When the walls 60,62 are made of a thin sheet metal or similar material, there is no need to thread the inside of the hole 72 for engagement with the door engaging member 59, which is described in more detail below.

As illustrated, the slot 70 in each wall 60,62, and the hole 72 in each wall 60,62 are preferably substantially aligned. In particular, it is desired that the walls 60,62 be arranged such that the are parallel to one another with the slots 70 and holes 72 aligned.

The walls 60,62 are preferably separated by a distance of about ½ inch, and most preferably about 31/64 of an inch, thus causing the base 64 and top and bottom member 66,68 to be appropriately sized, as will be appreciated to one skilled in the art. In particular, it is desired that the walls 60,62 be separated by a distance corresponding to the distance between the first and second sets of notches 50,52. As will be described in more detail later, this arrangement is provided in order that is be possible for the sets of notches 50,52 in the strap 22 and the slots 70 in the walls 60,62 of the frame 24 to engage on another.

The door engaging member 59 for use with the frame 24 preferably comprises a threaded bolt having a first user engaging end 74 and a second door engaging end 76. The user engaging end 74 preferably includes a head 78 or member for easy engagement by the fingers of a user. The head 78 may thus comprise a plastic, metal or other suitable member having serrations or other friction increasing members thereon.

The door engaging end 76 preferably comprises a rotatable, flat foot 80 for engagement against a door or other member. Further, in order to prevent marring of the surface of a door or other member, it is preferred that the foot 80 have felt or a similar soft durable material located thereon.

Preferably, the threads on the door engaging member 59 are very large, allowing the door engaging member to be quickly advanced back and forth towards the door. Further, the large threads eliminates the need to thread the holes 72 in the walls 60,62.

During manufacture of the device 20, it is preferred that the frame 24 be located on the strap 22, and that the stop 56 then be created. This allows the device 20 to be presented to the user in a form which prevents removal of the frame 24 from the strap 22. This means that the user can not lose the components of the lock device 20. The same is true with respect to the door engaging member 59, in that it is desired that this member is located in the frame 24 as described and illustrated before the device 20 is presented to the user.

Figure 2:
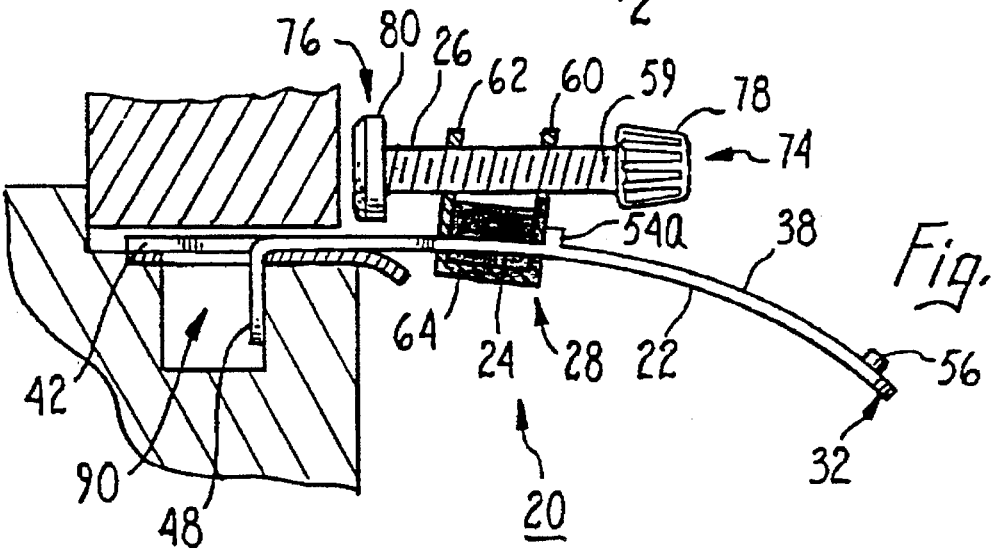
FIG. 2 is a top view of the door lock device of FIG. 1, illustrated in position for locking of a door.

The method of locking one or more doors will now be described in conjunction with FIGS. 1–3. First, the door engaging member 59 is checked to ensure that it is back off from its forward position, meaning that the foot 80 is located near the second wall 24 of the frame 62. Second, the frame 24 is located near the second end 32 of the strap 22.

Next, the strap 22 is positioned in a door bolt or latch recess 90. As illustrated, this is accomplished by locating the projection 48 at the first end 30 of the strap 22 into the recess 90, and pressing the strap 22 against the surrounding structure. It is noted that the lock device 20 works when the recess is in the frame of a door and the surrounding structure is the striker plate and door frame itself, or when the recess is located in the second of a double door set.

Next, the open door is shut. It is clear that at this time, the curvature of the strap 22 coupled with the location of the frame 24 near the second end 32 of the strap 22 allows the door to pass by the frame 24 and be shut. While it is possible to accomplish this function simply by placing the frame 24 a substantial distance away from the door, for example by making the strap 22 straight and very long, the curvature of the strap 22 of the present invention allows the strap 22 to be much shorter.

Once the door is shut, the first end 30 of the strap 22 is securely located between the door and the second door or door frame. The frame 24 is then slid along the strap 22 towards the door. The frame 24 is slid forward until the first wall 60 passes past the tabs 54. At this time release of pressure on the frame 24 causes gravity to pull the frame 24 downwardly into engagement with the sets of notches 50,52 in the strap. Engagement occurs when the slots 70 in the frame 24 engage the sets of notches 50,52 in the strap 22. When this occurs, the frame 24 drops down until the top of the slots 70 therein engage the first edge 38 of the strap 22 in the notches 50,52. Further, at that time, the tabs 54 engage the first wall 60 of the frame 24, preventing the frame 24 from being moved rearwardly on the strap 22. The means for securing 28 the frame 24 to the strap 22 thus comprises the interengagement of the notches 50,52 with the slots 70 and the engagement of the tabs 54 with the wall 60 of the frame 24.

The door engaging member 59 is then engaged and advanced towards the door. In the present embodiment, this is accomplished by turning the head 78 until the foot 80 moves against the door. At that time, the door is securely locked closed, whether it be a single door or double door set which were engaged.

It is noted that the door is securely locked regardless of the pressure which is applied to the device 20, as the frame 24 and door engaging member 59 are prevented from rearward movement. Further, the door is easily unlocked and the lock transported to a new location simply by reversing the above-stated process.

While the embodiment described above is the preferred embodiment, it is noted that several changes to the above described design can be made without departing from the essence of the invention. In particular, it is possible for their to be only one tab 54 extending from the strap 22. Further, it is possible for the frame 24 to consist of a single wall having a slot and hole therein. In the instance in which only one wall comprises the frame, only one set of notches need be provided in the strap.

It is also possible for the notches in the strap to only be located along one edge thereof. Having notches 50,52 in both edges 38,40 allows the device 20 to work with either the first or second edge 38,40 "up." This allows the device 20 to be used on a door which has the hinges located on either the right or left side. If the notches are only located on one edge, the device can only be used in one position (that which allows the slots in the walls of the frame to drop into engagement with the notches in the strap).

It is also noted that the tab or tabs 54 need not be located near the edges 38,40 of the strap 22, but could be located even near the center of either side 34,36 thereof. Of course, in such an instance, a similarly located slot must be provided in the frame 24 to allow the frame 24 to be passed over the tab(s) and drop into engagement therewith.

It is possible to eliminate the tabs 54 altogether, although this is not desirable. For instance, if the notches in the strap 22 are deep enough, the frame 24 may be fairly well secured to the strap 22 and prevented from rearward movement thereon simply because the wall 60 of the frame 24 engages the ledge created in the strap 24 by the deep notch thereon. This design is not desirable from the standpoint that excessive pressure or vibration could cause the frame 24 to jump from the notches 50,52 and be allowed to move rearwardly on the strap. In the instant case, the addition of the tabs 54 virtually eliminates the possibility that this event could ever occur because random alignment of the tabs in the slots coupled with direct rearward movement of the frame is very unlikely.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A portable door locking device, comprising:

a generally rigid, elongated, flat strap having a forward end portion and opposite rearward end portion, first and second parallel longitudinal edges and a transverse projection at a forward end portion thereof adapted to engage an opening in a striker plate;

a frame slidably mounted on the strap, said frame having a vertical notch-engaging wall portion;

stop means at the rearward end portion of the strap to preclude the frame from sliding off of the strap;

a retaining bolt threadedly mounted on the frame, said bolt having a foot portion adapted to abut the surface of a door when the locking device is in place; and releasable engagement means for retaining the frame in an operating position on the strap between the forward and rearward end portions, said engagement means comprising a first set of aligned notches extending inwardly respectively from the first and second edges, and first and second aligned tab means extending transversely to the strap rearward of the first set of notches for engaging a tab stop portion of the frame.

2. The device of claim 1, wherein said rearward end portion is curved with respect to said forward end portion.

3. The device of claim 1, wherein said releasable engagement means includes a second set of aligned notches located between said forward end portion and said first set of aligned notches.

4. The device of claim 1, wherein said vertical notch-engaging wall portion comprises a wall having a longitudinal slot therein.

5. The device of claim 3, wherein said frame includes first and second walls having slots therein, said first and second walls spaced to allow said slots to engage said first and second sets of notches.

6. A door locking device, comprising:

a strap having a first end and second end, first end including an outward projection for engaging a door latch engaging recess;

a frame having a door engaging member movably mounted thereon, located on said strap; and means for preventing movement of said frame along said strap comprising at least one notch and one outwardly extending tab on said strap for engagement with said frame.

7. The door locking device of claim 6 wherein said frame is slidably located on said strap.

8. The door locking device of claim 6, wherein said frame includes at least one wall having a slot therein, whereby said slot in said wall and said notch in said strap are engageable, with the wall engaging said tab simultaneously.

9. The door locking device of claim 6, wherein said means for preventing movement comprises aligned first and second notches and first and second tabs located behind said first and second notches and extending outwardly from said strap.

10. The door locking device of claim 9, wherein said means for preventing movement further comprises third and fourth aligned notches in said strap.

11. The door locking device of claim 6, wherein said door engaging member comprises a threaded bolt located on said frame, said bolt including a foot member for engagement with a door.

12. The door locking device of claim 6, wherein said strap includes stop means located at said second end thereof.

13. A door locking device, comprising:

a frame member having a slot therein for location on a strap member, said frame member further including a hole therein for location of a door engaging bolt, said door engaging bolt comprising an elongate threaded member having a first end for engagement by a user and a second end for contact with a door member, said strap member having a first end and second end, said first end including an outwardly extending projection for engagement with a recess, said second end curved away from said first end, said strap further including at least a first set of notches for engagement with said slot in said frame, and at least one outwardly extending tab on said strap for engaging said frame when said slot in said frame and said first set of notches on said strap are engaged, for preventing movement of said frame towards said second end of said strap.

14. The door lock device of claim 13, wherein said frame includes a first wall having a first slot therein and a second wall having a second slot therein.

15. The door lock device of claim 14, wherein a second set of notches are provided on said strap, whereby when said first set of notches are engaged by said first slot, said second set of notches are engaged by said second slot.

16. A door locking device, comprising:

a frame comprising first and second walls connected to one another, said first and second walls each containing an elongate slot therein and a bore therethrough, the slot and bore in said first and second walls being in substantial alignment with one another;

a threaded bolt member for location on said frame in said bores, said bolt including a first end for gripping by a user and a second end for engaging a door member;

a strap, said strap comprising an elongate, thin body having top and bottom edges and first and second ends, said first end including a recess engaging projection extending outwardly from said strap and elongate fingers for location about said recess, said second end curving away from said first end, a first set of notches comprising aligned notches on said top and bottom edges of said strap, a second set of notches comprising aligned notches on said top and bottom edges of said strap, said first and second sets of notches located between said first and second ends of said strap, said first and second sets of notches spaced apart by a distance substantially the same as the distance between said first and second walls of said frame, said strap further include outwardly extending tabs located near said first set of notches and towards the second end of said strap, said tabs extending outwardly from said strap by a distance less than the width of said slot in each of the first and second frame walls, and said strap further including a stop located at said second end of said strap, said stop extending outwardly from said strap by a distance greater than the width of said notches in said frame walls.

17. A method of locking a door, comprising:

inserting an outwardly extending member of a door lock strap into a door latch recess when said door is open;

closing said door;

sliding a frame along a curved portion of said strap towards said door;

locking said frame into engagement with said strap by engaging said frame with at least one notch located on said strap; and engaging said door with a door engaging member movably located on said frame.

18. The method of claim 17, wherein said locking further comprises engaging said frame with an outwardly extending tab located on said strap.

* * * * *